US009138861B2

(12) United States Patent
Wu et al.

(10) Patent No.: US 9,138,861 B2
(45) Date of Patent: Sep. 22, 2015

(54) CMP PAD CLEANING APPARATUS

(75) Inventors: Jiann Lih Wu, Hsin-Chu (TW); Bo-I Lee, Sindian (TW); Huang Soon Kang, Hsin Chu (TW); Chi-Ming Yang, Hsinchu (TW); Chin-Hsiang Lin, Hsin-Chu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 672 days.

(21) Appl. No.: 13/396,854

(22) Filed: Feb. 15, 2012

(65) Prior Publication Data

US 2013/0210323 A1 Aug. 15, 2013

(51) Int. Cl.
*B24B 53/00* (2006.01)
*B24B 53/017* (2012.01)

(52) U.S. Cl.
CPC ..... *B24B 53/017* (2013.01)

(58) Field of Classification Search
CPC ..... B24B 53/017
USPC ..... 451/56, 443, 444, 285–290
See application file for complete search history.

(56) References Cited

U.S. PATENT DOCUMENTS

| | | | | |
|---|---|---|---|---|
| 5,616,069 | A * | 4/1997 | Walker et al. | 451/56 |
| 5,779,522 | A * | 7/1998 | Walker et al. | 451/56 |
| 5,868,608 | A * | 2/1999 | Allman et al. | 451/72 |
| 5,916,010 | A * | 6/1999 | Varian et al. | 451/38 |
| 6,241,587 | B1 * | 6/2001 | Drill et al. | 451/56 |
| 6,517,416 | B1 * | 2/2003 | Crevasse et al. | 451/41 |
| 6,554,688 | B2 * | 4/2003 | Lacy | 451/56 |
| 6,692,339 | B1 * | 2/2004 | Halley | 451/41 |
| 6,764,388 | B2 * | 7/2004 | Liu et al. | 451/56 |
| 6,791,242 | B2 | 9/2004 | Beck et al. | |
| 6,875,091 | B2 * | 4/2005 | Radman et al. | 451/56 |
| 7,033,246 | B2 * | 4/2006 | Elledge et al. | 451/5 |
| 7,040,967 | B2 * | 5/2006 | Benner | 451/56 |
| 7,559,824 | B2 | 7/2009 | Park et al. | |
| 2007/0077871 | A1 * | 4/2007 | Park et al. | 451/56 |

OTHER PUBLICATIONS

ProSys: Product Systems Inc., "Brush Replacement Overview", Jun. 2011, p. 1-9.
ProSys: Product Systems Inc., "MegPie Operational Summary", Jun. 2011, p. 1-21.

* cited by examiner

*Primary Examiner* — Maurina Rachuba
(74) *Attorney, Agent, or Firm* — Eschweiler & Associates, LLC

(57) ABSTRACT

The present disclosure relates to a two-phase cleaning element that enhances polishing pad cleaning so as to prevent wafer scratches and contamination in chemical mechanical polishing (CMP) processes. In some embodiments, the two-phase pad cleaning element comprises a first cleaning element and a second cleaning element configured to successively operate upon a section of a CMP polishing pad. The first cleaning element comprises a megasonic cleaning jet configured to utilize cavitation energy to dislodge particles embedded in the CMP polishing pad without damaging the surface of the polishing pad. The second cleaning element is configured to apply a high pressure mist, comprising two fluids, to remove by-products from the CMP polishing pad. By using megasonic cleaning to dislodge embedded particles a two-fluid mist to flush away by-products (e.g., including the dislodged embedded particles), the two-phase pad cleaning element enhances polishing pad cleaning.

20 Claims, 6 Drawing Sheets

CMP PAD CLEANING APPARATUS

BACKGROUND

Integrated chips are constructed using complex fabrication processes that form a plurality of different layers on top of one another. Many of the layers are patterned using photolithography, in which a light sensitive photoresist material is selectively exposed to light. For example, photolithography is used to define back end metallization layers that are formed on top of one another. To ensure that the metallization layers are formed with a good structural definition, the patterned light must be properly focused. To properly focus the pattered light, a workpiece must be substantially planar to avoid depth of focus problems.

Chemical mechanical polishing (CMP) is a widely used process by which both chemical and physical forces are used to globally planarize a semiconductor workpiece. The planarization prepares the workpiece for the formation of a subsequent layer. A typical CMP tool comprises a rotating platen covered by a polishing pad. A slurry distribution system is configured to provide a polishing mixture, having chemical and abrasive components, to the polishing pad. A workpiece is then brought into contact with the rotating polishing pad to planarize the workpiece.

DETAILED DESCRIPTION

Figure 1:
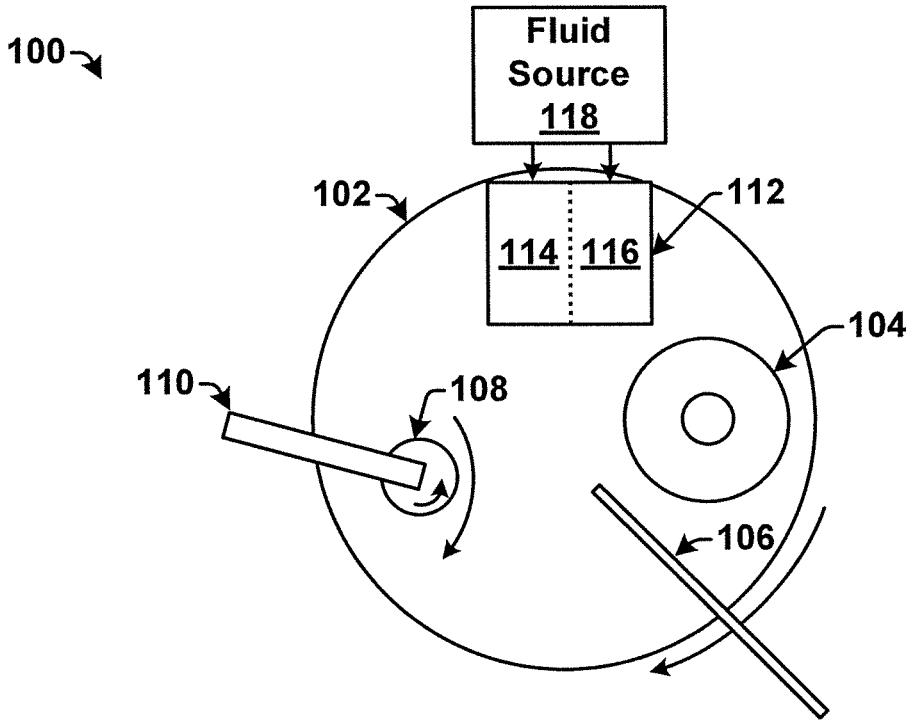
FIG. 1 illustrates a top view of some embodiments of a chemical mechanical polishing tool having a two-phase cleaning element configured to clean a CMP polishing pad.

The description herein is made with reference to the drawings, wherein like reference numerals are generally utilized to refer to like elements throughout, and wherein the various structures are not necessarily drawn to scale. In the following description, for purposes of explanation, numerous specific details are set forth in order to facilitate understanding. It may be evident, however, to one of ordinary skill in the art, that one or more aspects described herein may be practiced with a lesser degree of these specific details. In other instances, known structures and devices are shown in block diagram form to facilitate understanding.

Conventional chemical mechanical polishing (CMP) tools use CMP polishing pads made out of porous materials. During operation, by-products of the CMP tool may become embedded into the porous material. As the porous pad is brought into contact with a semiconductor workpiece the embedded by-products can scratch the workpiece, causing defects in an integrated chip. Such defects pose an increasing problem to semiconductor yields as the minimum features sizes implemented on the workpieces decrease.

For example, over time slurry accumulation and smoothing of a CMP polishing pad cause a degradation of the polishing rate and planarity achieved by a CMP tool. To maintain a high degree of planarity, many modern CMP tools use an abrasive conditioning pad to condition the CMP polishing pad. The abrasive conditioning pad often comprises a diamond grit and is connected to conditioning arm, which moves back and forth across a CMP polishing pad to condition the polishing pad as it rotates. As workpiece sizes have increased, for example to 300 mm or 450 mm, larger CMP polishing pads are used, requiring conditioning tools to condition larger areas. This may lead to an increase in diamond grit breaking off of the conditioning pad and scratching of a workpiece.

Accordingly, some aspects of the present disclosure provide for a two-phase pad cleaning element that enhances pad cleaning so as to prevent wafer scratches and contamination in chemical mechanical polishing (CMP) processes. In some embodiments, the two-phase pad cleaning element comprises a first cleaning element and a second cleaning element configured to successively operate upon a section of a CMP polishing pad that is located downstream of a diamond conditioning pad. The first cleaning element comprises a megasonic cleaning jet configured to utilize cavitation energy to dislodge by-products embedded in the CMP polishing pad without significantly damaging the surface of the polishing pad. The second cleaning element is configured to apply a high pressure mist, comprising two fluids, to remove residue from the CMP polishing pad. By using megasonic cleaning to dislodge embedded particles a two fluid mist to flush away residue (e.g., including the dislodged embedded particles), the two-phase pad cleaning element enhances polishing pad cleaning so as to prevent wafer scratches and contamination in a CMP process.

FIG. 1 illustrates a top view of some embodiments of a chemical mechanical polishing (CMP) tool 100 having a two-phase cleaning element 112 configured to clean a CMP polishing pad 102.

The CMP tool 100 comprises a polishing pad 102 configured to perform polishing of a semiconductor workpiece. The polishing pad 102 is located on a rotating platen, which rotates the polishing pad 102 during operation of the CMP tool 100. A slurry supply element 106 is configured to deposit a polishing mixture onto the polishing pad 102. In general, the polishing mixture comprises a dilute slurry having abrasive particles that are used in mechanical polishing of a workpiece and one or more chemicals (e.g., $H_20_2$, $NH_4OH$, etc.) that are used in chemical polishing of the workpiece. A workpiece carrier 104, configured to house the workpiece, is operable to bring the workpiece into contact with the rotating polishing pad 102. By bringing the workpiece into contact with the rotating polishing pad 102, polishing of the workpiece is performed.

As the platen rotates, a pad conditioning element is configured to condition the polishing pad 102. The pad conditioning element comprises a conditioning pad 108 connected to conditioning arm 110, which is configured to move back and fourth across the polishing pad 102 to condition the polishing pad 102. In some embodiments, the conditioning pad 108 comprises a diamond grit conditioning pad having a plurality of diamonds affixed to the pad. The diamonds act as a sandpaper to roughen the surface of the polishing pad 102, thereby increasing the performance of mechanical polishing.

The CMP tool 100 further comprises a two-phase cleaning element 112 configured to clean the polishing pad 102. The two-phase cleaning element 112 comprises a first cleaning element 114 and a second cleaning element 116, which are configured to successively operate upon a section of the polishing pad 102 to remove by-products from the polishing pad 102. The two-phase cleaning element 112 is configured to perform a two-step cleaning of the polishing pad 102 using different cleaning techniques. The first cleaning element 114 is configured to perform cleaning that dislodges defects such as by-products of the CMP tool 100 (e.g., including diamond particles that have fallen off of the conditioning pad 108) that are embedded in the polishing pad 102, while the second cleaning element 116 is configured to remove residue (e.g., including the dislodged embedded by-products) from the surface of the polishing pad 102.

In some embodiments, the two-phase cleaning element 112 is positioned along the rotational path of the polishing pad 102 at a location that is downstream of the conditioning pad 108 and upstream of the workpiece carrier 104. For example, as the polishing pad 102 rotates, a point on the polishing pad 102 travels by the conditioning pad 108, then by the two-phase cleaning element 112, and then by the workpiece carrier 104. Locating the two-phase cleaning element 112 between the conditioning pad 108 and the workpiece carrier 104 allows the two-phase cleaning element 112 to remove any by-products of the conditioning pad 108 that are embedded in the polishing pad 102 prior to the workpiece carrier 104 being operated to polish the workpiece, thereby reducing scratches in the workpiece.

In some embodiments, the first cleaning element 114 and the second cleaning element 116 are connected to a cleaning fluid source 118. The cleaning fluid source 118 is configured to provide one or more cleaning fluids (e.g., a liquid and/or gas) to the first and second cleaning elements, 114 and 116. In some embodiments, one or more of the cleaning fluids provided to the first and second cleaning elements 114 and 116 is the same. In other embodiments, the cleaning fluid(s) provided to the first and second cleaning elements 114 and 116 are different.

Figure 2:
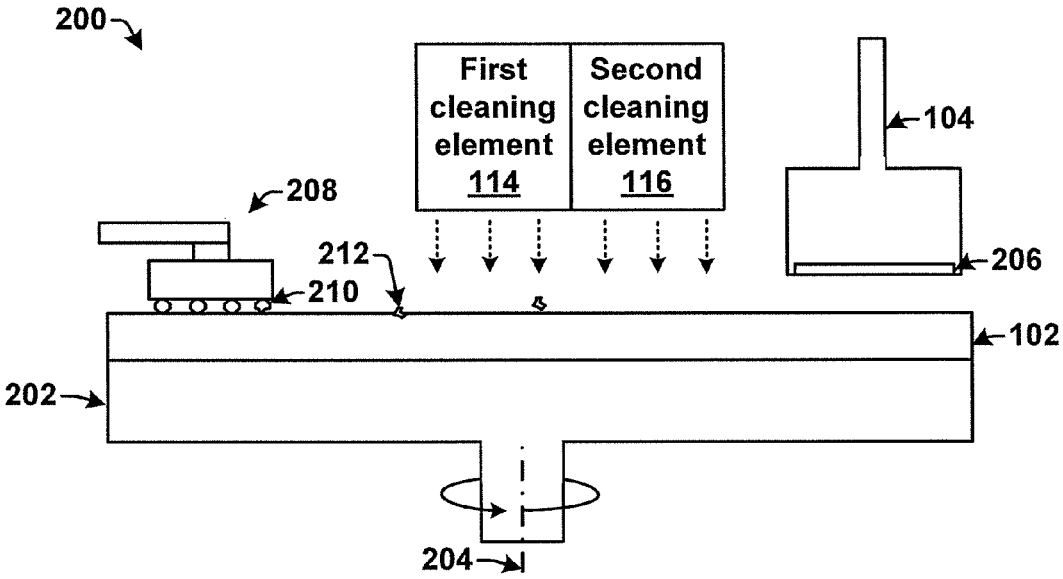
FIG. 2 illustrates a side view of some embodiments of a chemical mechanical polishing tool having a two-phase cleaning element configured to clean a CMP polishing pad.

FIG. 2 illustrates a side view of some embodiments of a CMP tool 200 having a two-phase cleaning element 112 configured to clean a CMP polishing pad 102.

The CMP tool 200 comprises a polishing pad 102 located on a rotating platen 202 that is configured to rotate about an axis of rotation 204. A workpiece carrier 104, housing a workpiece 206, is positioned above the rotating polishing pad 102

The CMP tool 200 further comprises a pad conditioning element 208 comprising a diamond grit conditioning pad having a plurality of diamond particles 210. The plurality of diamond particles 210 are located along a side of the pad conditioning element 208 that faces a top surface of the polishing pad 102. During operation, the pad conditioning element 208 pushes on the polishing pad 102 with a downward force that brings the plurality of diamond particles 210 into contact with the polishing pad 102. As the polishing pad 102 is rotated by the platen 202, the diamond particles 210 roughen the surface of the polishing pad 102 to provide for improved mechanical polishing.

The two-phase cleaning element 112 is located downstream of the conditioning pad 108 and is configured to remove by-product particles that are embedded in the polishing pad 102 before the workpiece carrier 104 is operated to bring the workpiece 206 into contact with the polishing pad 102. By removing by-products upstream of the workpiece carrier 104, scratches in the workpiece 206 are reduced. In some embodiments, the first cleaning element 114 is configured to utilize cavitation energy to dislodge by-product particles embedded in the polishing pad 102, while the second cleaning element 116 is configured to bombard the surface of the polishing pad with one or more fluids to remove residue of the polishing process and/or of the first cleaning element 114 from the polishing pad 102.

For example, during conditioning of the polishing pad diamond by-products 212 may fall off of the conditioning pad 108 and become embedded into the porous material of the polishing pad 102. The first cleaning element 114 is configured to dislodge the embedded diamond by-products 212 from the polishing pad 102 by way of cavitation energy. The second cleaning element 116 is subsequently configured to bombard the polishing pad 102 with one or more fluids to remove the dislodged diamond by-products 212 from the surface of the polishing pad 102.

Figure 3:
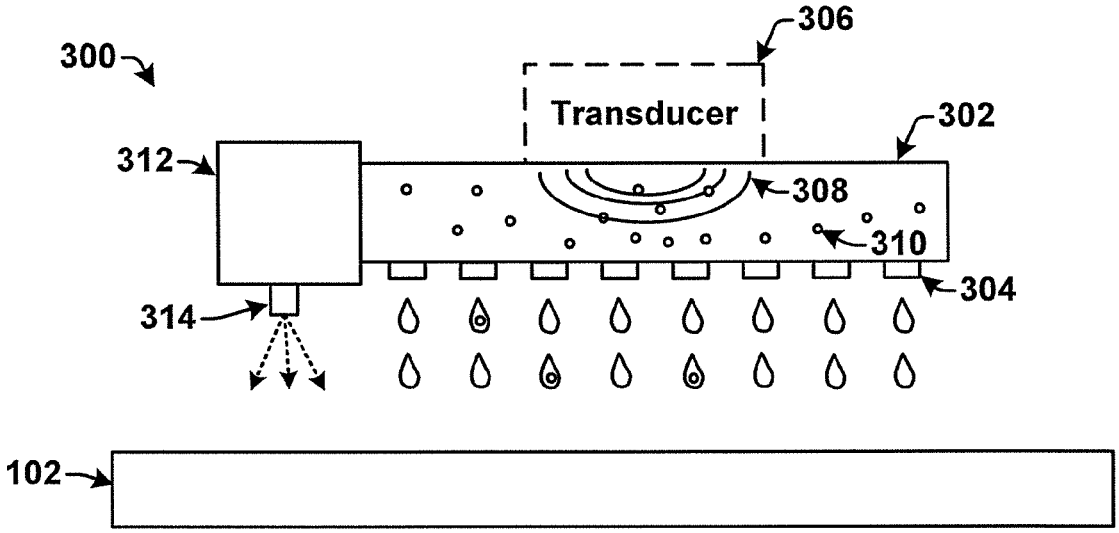
FIG. 3 illustrates a side view of some embodiments of a two-phase cleaning element comprising a two-phase fluidic cleaning arm, as disclosed herein.

FIG. 3 illustrates a side view of some exemplary embodiments of a two-phase cleaning element comprising a two-phase fluidic cleaning arm 300, as disclosed herein.

The fluidic cleaning arm 300 comprises a first cleaning element comprising an acoustic cleaning element 302 and a second cleaning element comprising a high pressure fluid jet 312.

The acoustic cleaning element 302 is configured to generate cavities 310 within a cleaning fluid. When the cavities 310 come into contact with the surface of the polishing pad 102 they release energy that dislodges embedded by-products from the surface of the polishing pad 102. In some embodiments, the cavities 310 are formed in a cleaning fluid that is subsequently deposited onto a polishing pad 102. In such an embodiment, the cavities 310 are formed within the cleaning fluid while it is within the acoustic cleaning element 302. The cavities 310 are subsequently transferred to the polishing pad 102 by way of a plurality of nozzles 304 configured to disperse liquid droplets containing one or more cavities 310 onto the surface of the polishing pad 102, as shown in FIG. 3. In other embodiments, the cavities 310 are formed in a liquid that is in contact with the polishing pad 102. For example, in some embodiments, the rotational frequency is configured to form cavities 310 within slurry residue that is on the surface of the polishing pad 102.

In some embodiments, the acoustic cleaning element 302 comprises a megasonic cleaning jet configured to dislodge embedded particles from the polishing pad through the use of megasonic cavitation energy. Megasonic cavitation energy operates a higher frequency (e.g., in a range from about 200 kHZ to about 2000 kHz or more) than other acoustic cleaners (e.g., ultrasonic cleaners). The higher megasonic frequencies result in the formation of small, relatively stable cavities 310. The small, relatively stable cavities 310 convey a small amount of energy upon collapse, thereby not causing cavitation damage found at lower (e.g., ultrasonic) acoustic cleaning frequencies. Furthermore, it will be appreciated that megasonic cleaning is more effective at removing small particles from a substrate than lower frequency acoustical cleaning. Accordingly, a disclosed megasonic cleaning jet dislodges embedded particles from the polishing pad 102 without significantly damaging the surface of the polishing pad 102 (e.g., without decreasing the operable lifetime of the polishing pad 102).

In some embodiments, the megasonic cleaning jet comprises one or more megasonic energy sources configured to transmit megasonic energy into a cleaning fluid. In some embodiments, the megasonic energy sources comprise one or more transducer elements 306 (e.g., one or more piezoelectric transducers) configured to convert electrical energy into mechanical energy. The transducer elements 306 are configured to oscillate at a frequency in a range from about 200 kHZ to about 2000 kHz, producing pressure waves 308 within the cleaning fluid. The pressure waves 308 alternate between high pressure waves and low pressure waves, such that the cleaning fluid is compressed by the high pressure waves and decompressed by the low pressure waves. As the low pressure waves decompress the cleaning fluid, cavities 310 form within the cleaning fluid. When the cavities 310 implode, they released an energy that is large enough to overcome particle adhesive forces and to dislodge abrasive by-products embedded within the polishing pad 102.

The high pressure fluid jet 312 comprises a plurality of nozzles 314 configured to apply a high pressure fluid to the polishing pad 102. In some embodiments, the a high pressure fluid jet 312 is configured to apply a high pressure mist comprising two fluids (i.e., a two-fluid mist) by way of a plurality of nozzles 314. For example, the two-fluid mist may comprise a mixture of a liquid (e.g., de-ionized water) and a gas (e.g., nitrogen gas ($N_2$)). By mixing a liquid with a gas, the size of liquid droplets output by nozzles 314 can be reduced (e.g., from 50 um to 10 um). Furthermore, the liquid droplets can be applied to the polishing with an extremely high pressure of up to approximately 90 PSI.

Figure 4:
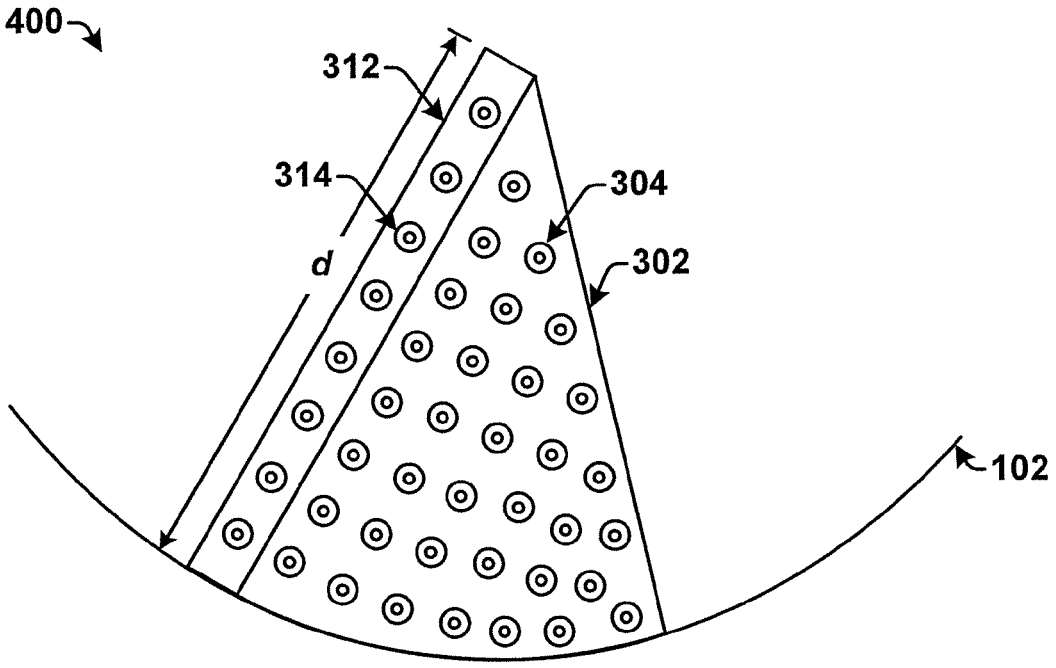
FIG. 4 illustrates a top view of some embodiments of a two-phase cleaning element comprising a two-phase fluidic cleaning arm, as disclosed herein

FIG. 4 illustrates a top view of some embodiments of a two-phase cleaning element comprising a two-phase fluidic cleaning arm 400, as disclosed herein. The two-phase fluidic cleaning arm 400 is configured to extend over the polishing pad 102 to a distance d. In some embodiments, the distance d is equal to the radius of the polishing pad 102.

As shown in FIG. 4, the acoustic cleaning element 302 comprises a plurality of nozzles configured in a sector type nozzle layout. The sector type nozzle layout comprises a plurality of nozzles 304 distributed evenly over a triangular shaped acoustic cleaning element 302, allowing for a larger number of nozzles to distribute cleaning solution as the radial distance from the center of the polishing pad 102 increases. By using a larger number of nozzles to distribute cleaning solution as the radial distance from the center of the polishing pad 102 increases, the sector type nozzle layout provides for a uniform energy distribution over the polishing pad 102. This is because the speed at which the polishing pad 102 passes the acoustic cleaning element 302 increases as the radial distance from the center of the polishing pad 102 increases, causing different radiuses to utilize different energies.

The high pressure fluid jet 312 comprises a bar type nozzle layout. The bar type nozzle layout comprises a plurality of nozzles 304 distributed linearly over a bar shaped high pressure fluid jet 312. The bar type nozzle layout is sufficient to provide the two-fluid mist over the surface of the polishing pad 102.

Figure 5:
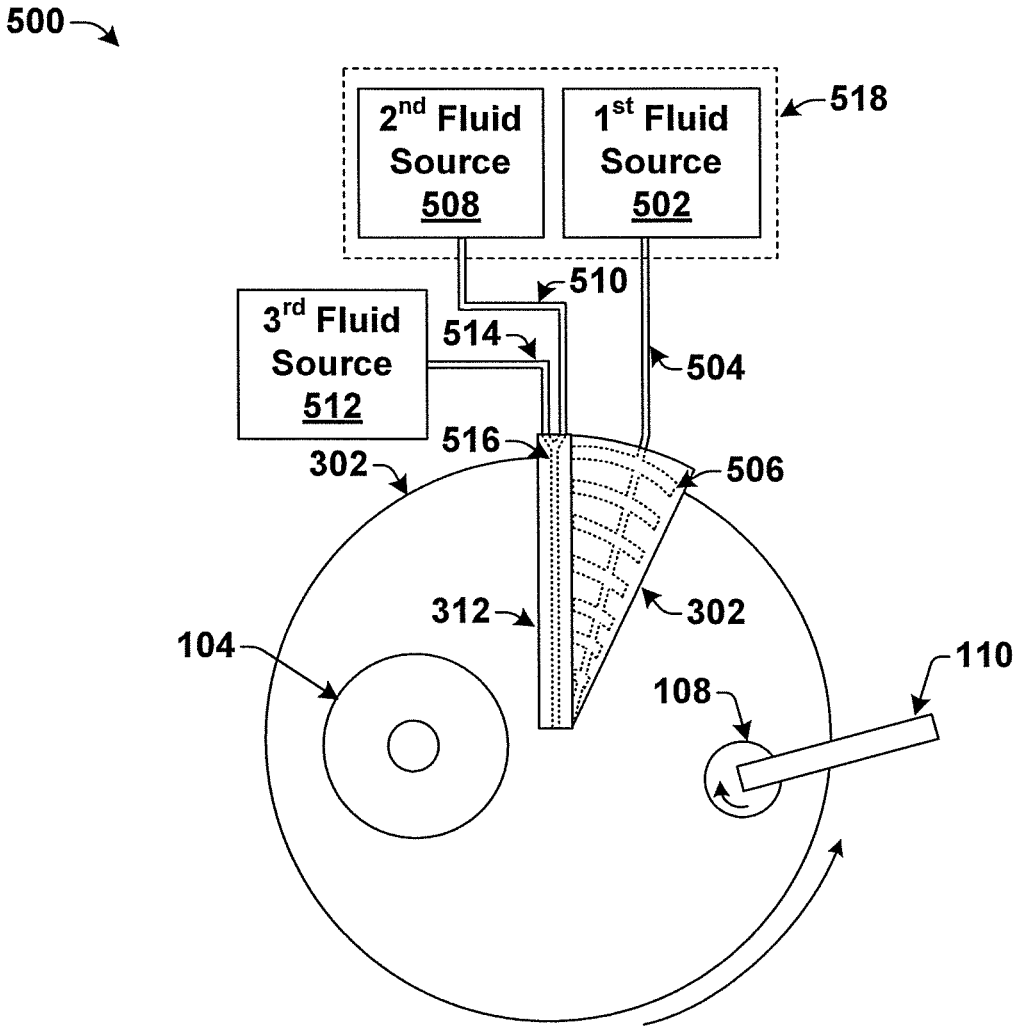
FIG. 5 illustrates a top view of some embodiments of a chemical mechanical polishing tool having a two-phase fluidic cleaning arm operating on a CMP polishing pad

FIG. 5 illustrates a top view of some embodiments of a CMP tool 500 having a two-phase fluidic cleaning arm operating on a CMP polishing pad 102.

The CMP tool 500 comprises an acoustic cleaning element 302 that is connected to a first fluid source 502 by way of a first conduit 504. The first fluid source 502 is configured to provide a first cleaning fluid to channels 506 that extend throughout the sector type nozzle layout of the acoustic cleaning element 302 to provide the first cleaning fluid to the nozzles.

The a high pressure fluid jet 312 is connected to a second fluid source 508 by way of a second conduit 510 and to a third fluid source 512 by way of a third conduit 514. The second fluid source 508 is configured to provide a second fluid to channels 516 within the bar type nozzle of a high pressure fluid jet 312, while the third fluid source 512 is configured to provide a third fluid to the channels 516 within the bar type nozzle of the a high pressure fluid jet 312. The high pressure fluid jet 312 is configured to output a two-fluid high pressure mist comprising a mixture of the first and second fluids.

In some embodiments, the first fluid source 502 and the second fluid source 508 comprise a same fluid source 518, such that the acoustic cleaning element 302 and the high pressure fluid jet 312 receive a same fluid. For example, the first and second fluid sources, 502 and 508, may comprise a fluid source configured to provide de-ionized water to the acoustic cleaning element 302 and the high pressure fluid jet 312, while the second fluid source 508 may additionally provide a fluid comprising nitrogen gas to the high pressure fluid jet 312.

Figure 6:
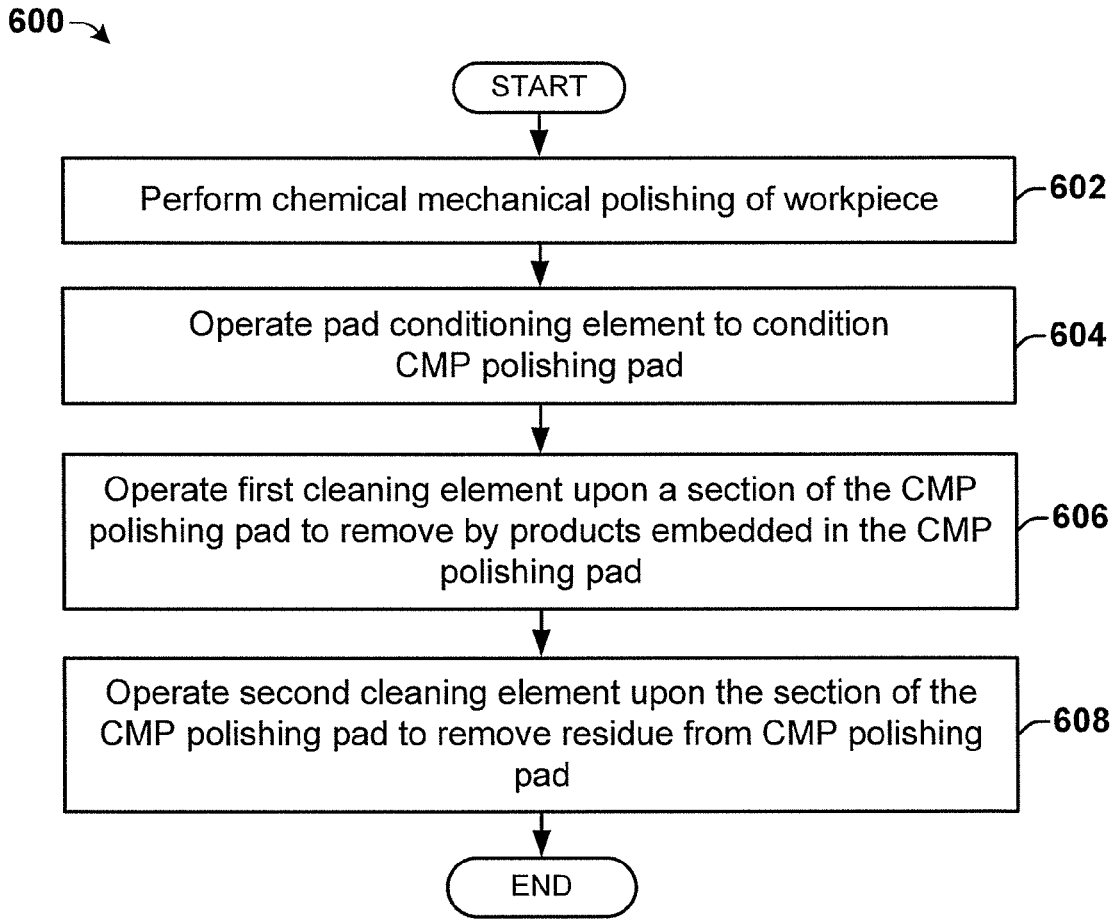
FIG. 6 is a flow diagram of some embodiments of a method for improved CMP polishing pad cleaning utilizing a two phase cleaning process.

FIG. 6 illustrates a flow diagram of some embodiments of a method 600 for improved CMP polishing pad cleaning utilizing a two-stage cleaning process. While the method 600 provided herein is illustrated and described below as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At 602 chemical mechanical polishing of a semiconductor workpiece is performed. In some embodiments, the chemical mechanical polishing is performed by providing a polishing mixture to a chemical mechanical polishing pad. The polishing pad is rotated about an axis of rotation and a workpiece carrier is operated to bring a semiconductor workpiece into contact with a surface of the rotating polishing pad.

At 604 a pad conditioning element is operated to condition the polishing pad. In some embodiments, the pad conditioning element comprises a conditioning pad having a diamond grit that is run across the surface of the polishing pad as it rotated about the axis of rotation.

At 606 a first cleaning element is operated upon a section of the CMP polishing pad to remove by-products embedded in the polishing pad. In some embodiments, the by-products comprise diamond particles that have fallen off of the conditioning pad and become embedded in the polishing pad. In some embodiments, the first cleaning element is configured to operate upon the workpiece utilizing cavitation energy to remove the by-products embedded in the polishing pad. For example, in some embodiments, operating a first cleaning element comprises operating a megasonic energy source to form cavities within a first fluid and applying the first fluid to the surface of the polishing pad, so that the cavities transfer a sufficient energy to particles embedded in the polishing pad to dislodge the by-products from the polishing pad.

At 608 a second cleaning element is operated upon the section of the CMP polishing pad to remove residue from the polishing pad. The second cleaning element is configured to operate upon a section of the polishing pad after the first cleaning element operates upon the section. The second cleaning element cleans away residue of the CMP process along with by-products that were dislodged from the CMP pad by the first cleaning element. In some embodiments, the second cleaning element comprises a high pressure fluid jet configured to provide a high pressure mist to the workpiece. The two-fluid mist may comprise a two fluid mist having a liquid (e.g., de-ionized water) and a gas (e.g., nitrogen gas). The two-fluid mist may comprise a pressure of approximately 90 PSI.

Therefore, the method 600 prevents by-products embedded within a CMP polishing pad from damaging a workpiece during a chemical mechanical polishing process.

It will be appreciated that equivalent alterations and/or modifications may occur to one of ordinary skill in the art based upon a reading and/or understanding of the specification and annexed drawings. The disclosure herein includes all such modifications and alterations and is generally not intended to be limited thereby. In addition, while a particular feature or aspect may have been disclosed with respect to only one of several implementations, such feature or aspect may be combined with one or more other features and/or aspects of other implementations as may be desired. Furthermore, to the extent that the terms "includes", "having", "has", "with", and/or variants thereof are used herein, such terms are intended to be inclusive in meaning—like "comprising." Also, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

Therefore, the present disclosure relates to a two-phase cleaning element that enhances polishing pad cleaning so as to prevent wafer scratches and contamination in chemical mechanical polishing (CMP) processes.

In some embodiments, the present disclosure relates to a chemical mechanical polishing (CMP) tool, comprising a workpiece carrier configured to house a workpiece. A polishing pad is located on a platen configured to rotate around an axis of rotation. A conditioning pad is configured to condition a surface of the polishing pad to improve polishing performance. A two-phase cleaning element is located at a position that is downstream of the conditioning pad and upstream of the polishing pad. The two-phase cleaning element comprising a first cleaning element configured to remove defects from the surface of the polishing pad and a second cleaning element configured to remove residue from the surface of the polishing pad.

In another embodiment, the present disclosure relates to a chemical mechanical polishing (CMP) tool. The CMP tool comprises a workpiece carrier configured to house a semiconductor workpiece. The CMP tool further comprises a polishing pad located on a platen configured to rotate around an axis of rotation. The CMP tool further comprises a conditioning element comprising a diamond grit conditioning pad that faces a top surface of the polishing pad and that is configured to condition the top surface of the polishing pad to improve mechanical polishing performance. The CMP tool further comprises a megasonic cleaning element configured to remove defects from the polishing pad and a high pressure fluid jet configured to apply a high pressure two fluid mist to the surface of the polishing pad to remove residue.

In another embodiment, the present disclosure relates to a method for cleaning a chemical mechanical polishing pad. The method comprises bringing a workpiece into contact with a surface of the chemical mechanical polishing pad to perform chemical mechanical polishing of the workpiece. The method further comprises operating a pad conditioning element to condition the chemical mechanical polishing pad. The method further comprises operating a first cleaning element to dislodge defects from the surface of the chemical mechanical polishing pad and operating a second cleaning element to remove residues from the surface of the chemical mechanical polishing pad.

What is claimed is:

1. A chemical mechanical polishing (CMP) tool, comprising:

a workpiece carrier configured to house a workpiece;

a polishing pad located on a platen configured to rotate around an axis of rotation; and a conditioning pad configured to condition a surface of the polishing pad to improve polishing performance;

a two-phase cleaning element located at a position that is downstream of the conditioning pad and upstream of the workpiece carrier, comprising:

a first cleaning element configured to remove defects from the surface of the polishing pad, wherein the first cleaning element comprises a sector type nozzle layout comprising a plurality of nozzles arranged in a triangular layout having a width that increases as a distance from an edge of the polishing pad decreases; and a second cleaning element configured to remove residue from the surface of the polishing pad.

2. The CMP tool of claim 1, further comprising:

a first fluid source connected to the first cleaning element by way of a first conduit and configured to provide a first fluid to the first cleaning element.

3. The CMP tool of claim 2, wherein the first cleaning element comprises a megasonic cleaning jet, comprising:

a megasonic energy source configured to transmit megasonic energy to the first fluid; and a plurality of nozzles configured to apply the first fluid to the surface of the polishing pad wherein the first fluid utilizes the megasonic energy to dislodge particles embedded in the surface of the polishing pad.

4. The CMP tool of claim 3, wherein the megasonic energy source comprises a piezoelectric transducer configured to oscillate at a frequency in a range from about 200 kHZ to about 2000 kHz.

5. The CMP tool of claim 1, further comprising:

a second fluid source connected to the second cleaning element by way of a second conduit and configured to provide a second fluid to the second cleaning element; and a third fluid source connected to the second cleaning element by way of a third conduit and configured to provide a third fluid to the second cleaning element.

6. The CMP tool of claim 5, wherein the second cleaning element comprises a high pressure fluid jet comprising a plurality of nozzles configured to apply a two-fluid mist to the polishing pad comprising a mixture of the second fluid and the third fluid.

7. The CMP tool of claim 6, wherein the second fluid comprises de-ionized water and wherein the third fluid comprises nitrogen gas.

8. The CMP tool of claim 7, wherein the two-fluid mist comprises a pressure of approximately 90 psi.

9. The CMP tool of claim 1, wherein the conditioning pad comprises a diamond grit conditioning pad that faces the surface of the polishing pad.

10. A chemical mechanical polishing (CMP) tool, comprising:

a workpiece carrier configured to house a semiconductor workpiece;

a polishing pad located on a platen configured to rotate around an axis of rotation;

a conditioning element comprising a diamond grit conditioning pad that faces a top surface of the polishing pad and that is configured to condition the top surface of the polishing pad to improve mechanical polishing performance;

a megasonic cleaning element configured to remove defects from the polishing pad; and a high pressure fluid jet configured to apply a high pressure two fluid mist to the surface of the polishing pad to remove residue.

11. The CMP tool of claim 10, wherein the megasonic cleaning element comprises a plurality of nozzles configured in a triangular shaped sector type nozzle layout that provides for a uniform distribution of megasonic energy over the polishing pad.

12. The CMP tool of claim 10, further comprising:

a first fluid source connected to the megasonic cleaning element by way of a first conduit and configured to provide a first fluid to the megasonic cleaning element.

13. The CMP tool of claim 12, further comprising:

a second fluid source connected to the high pressure fluid jet by way of a second conduit and configured to provide a second fluid to the high pressure fluid jet; and a third fluid source connected to the high pressure fluid jet by way of a third conduit and configured to provide a third fluid to the high pressure fluid jet.

14. The CMP tool of claim 13, wherein the first and second fluid sources comprise a same fluid source configured to provide de-ionized water to the megasonic cleaning element and high pressure fluid jet; and wherein the third fluid comprises nitrogen gas.

15. A method for cleaning a chemical mechanical polishing pad, comprising:

bringing a workpiece into contact with a surface of the chemical mechanical polishing pad to perform chemical mechanical polishing of the workpiece;

operating a pad conditioning element to condition the chemical mechanical polishing pad;

operating a first cleaning element to dislodge defects from the surface of the chemical mechanical polishing pad, wherein the first cleaning element comprises a plurality of nozzles configured in a sector type nozzle layout that provides for a uniform distribution of megasonic energy over the surface of the chemical mechanical polishing pad; and operating a second cleaning element to remove residues from the surface of the chemical mechanical polishing pad, wherein operating the second cleaning element comprises applying a two-fluid mist to the surface of the polishing pad, wherein the two fluid mist comprises de-ionized water and nitrogen gas.

16. The method of claim 15, wherein operating the first cleaning element to dislodge the defects embedded in the polishing pad comprises:

operating a megasonic energy source to form cavities within a first fluid; and applying the first fluid to the surface of the chemical mechanical polishing pad, so that the cavities transfer a sufficient energy to particles embedded in the chemical mechanical polishing pad to dislodge embedded by-products from the chemical mechanical polishing pad.

17. The method of claim 15, wherein the two-fluid mist comprises a pressure of approximately 90 PSI.

18. The CMP tool of claim 10, wherein the high pressure two fluid mist comprises a mixture of de-ionized water and nitrogen gas.

19. The CMP tool of claim 18, wherein the high pressure two fluid mist is applied to the workpiece at a pressure of approximately 90 psi.

20. The CMP tool of claim 1, wherein the second cleaning element is configured to apply a two-fluid mist, comprising a mixture of de-ionized water and nitrogen gas, to the polishing pad.

* * * * *